US010036134B2

(12) United States Patent
Abeles

(10) Patent No.: US 10,036,134 B2
(45) **Date of Patent: *Jul. 31, 2018**

(54) PORTABLE WATER INFLATABLE BARRIER WITH INTERCONNECTABLE MODULES

(71) Applicant: Gary E Abeles, Verona, NJ (US)

(72) Inventor: Gary E Abeles, Verona, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/630,457

(22) Filed: Jun. 22, 2017

(65) Prior Publication Data

US 2017/0284046 A1 Oct. 5, 2017

Related U.S. Application Data

(63) Continuation-in-part of application No. 15/382,965, filed on Dec. 19, 2016, now Pat. No. 9,719,225, which is a continuation-in-part of application No. 15/016,606, filed on Feb. 5, 2016, now Pat. No. 9,556,574, which is a continuation of application No. 14/594,407, filed on Jan. 12, 2015, now Pat. No. 9,334,616, which is a continuation-in-part of application No. 13/663,756, filed on Oct. 30, 2012, now Pat. No. 8,956,077.

(60) Provisional application No. 61/553,403, filed on Oct. 31, 2011.

(51) Int. Cl.

| | |
|---|---|
| ***E02B 3/10*** | (2006.01) |
| ***E02B 7/02*** | (2006.01) |
| ***E02B 3/12*** | (2006.01) |
| ***E02B 7/00*** | (2006.01) |
| ***E02B 3/16*** | (2006.01) |

(52) U.S. Cl.
CPC ..... *E02B 3/108* (2013.01); *E02B 3/106* (2013.01); *E02B 3/127* (2013.01); *E02B 3/16* (2013.01); *E02B 7/005* (2013.01)

(58) Field of Classification Search
CPC ..... E02B 3/106; E02B 3/108; E02B 7/005
See application file for complete search history.

(56) References Cited

U.S. PATENT DOCUMENTS 3,213,628 A * 10/1965 Serota ..... E02B 3/108 220/62.21
4,692,060 A * 9/1987 Jackson, III ..... E02B 3/108 256/13
4,780,024 A * 10/1988 Obermeyer ..... E02B 7/005 405/115

(Continued)

*Primary Examiner* — Frederick L Lagman
(74) *Attorney, Agent, or Firm* — Maine Cernota & Rardin

(57) ABSTRACT

A portable, water-filled barrier system includes a plurality of water-fillable modules, each module being internally divided into cells that emulates a section of a sandbag dike or wall. Adjacent modules are interconnected by fastening mechanisms, such as loops attached to fronts or sides of the modules and connected by straps or clamps. Automatic valves can seal openings between the filled cells, so that a punctured cell will not cause cells below and behind to deflate. In embodiments, the barrier can be initially filled with air, positioned, and then filled with water while the air escapes through a pressure valve. A manifold can be used to simultaneously fill a plurality of cells. A flexible sheet can be installed beneath and in front of the assembled barrier so as to inhibit leakage of water under or between the cells.

18 Claims, 14 Drawing Sheets

(56) References Cited

U.S. PATENT DOCUMENTS 5,059,065 A * 10/1991 Doolaege ..... E02B 3/127 405/107
5,865,564 A * 2/1999 Miller ..... E02B 3/108 405/114
6,022,172 A * 2/2000 Siyaj ..... E02B 3/108 405/110
6,481,928 B1 * 11/2002 Doolaege ..... E01D 15/20 138/98
6,551,025 B2 * 4/2003 Dery ..... E02B 3/108 405/115
6,641,329 B1 * 11/2003 Clement ..... E02B 3/108 405/115
8,956,077 B2 * 2/2015 Abeles ..... E02B 3/108 405/111
9,334,616 B2 * 5/2016 Abeles ..... E02B 3/127
9,556,574 B2 * 1/2017 Abeles ..... E02B 3/127
9,719,225 B2 * 8/2017 Abeles ..... E02B 3/108
2005/0260038 A1 * 11/2005 Sousa Costa ..... E02B 3/127 405/115
2006/0099033 A1 * 5/2006 Boraggina ..... E02B 3/108 405/107
2006/0275084 A1 * 12/2006 Harbeck ..... E02B 3/108 405/116
2007/0140598 A1 * 6/2007 McGillick, Sr. ... B65D 88/1612 383/22
2007/0154264 A1 * 7/2007 Baruh ..... E02B 3/108 405/110
2007/0237586 A1 * 10/2007 Prestininzi ..... E02B 3/108 405/115
2009/0274519 A1 * 11/2009 Shaw ..... E02B 3/108 405/107
2010/0284747 A1 * 11/2010 Peterson ..... E02B 3/108 405/114
2012/0230766 A1 * 9/2012 Schnaars, Sr. ..... E02B 3/108 405/32
2014/0010601 A1 * 1/2014 Bradley, Sr. ..... E02B 3/06 405/302.7

* cited by examiner

PORTABLE WATER INFLATABLE BARRIER WITH INTERCONNECTABLE MODULES

RELATED APPLICATIONS

This application is a continuation in part of application Ser. No. 15/382,965, filed on Dec. 19, 2016, now U.S. Pat. No. 9,719,225. Application Ser. No. 15/382,965 is a continuation in part of application Ser. No. 15/016,606, filed on Feb. 5, 2016, now U.S. Pat. No. 9,556,574. Application Ser. No. 15/016,606 is a continuation of application Ser. No. 14/594,407, filed on Jan. 12, 2015, now U.S. Pat. No. 9,334,616. Application Ser. No. 14/594,407 is a continuation in part of application Ser. No. 13/663,756, filed on Oct. 30, 2012, now U.S. Pat. No. 8,956,077. Application Ser. No. 13/663,756 claims the benefit of U.S. Provisional Application No. 61/553,403, filed Oct. 31, 2011. All of these applications are herein incorporated by reference in their entirety for all purposes.

FIELD OF THE INVENTION

The invention relates to temporary barriers, such as dikes used for flood control, and more particularly, to water-filled portable barriers.

BACKGROUND OF THE INVENTION

Circumstances sometimes arise where a temporary dike, wall, or other barrier is needed to prevent a flood, landslide, or other threat from spreading and threatening lives and property. Often, such a temporary barrier is constructed from sandbags, whereby empty bags and a quantity of dirt or sand is brought to the site, and a crew of workers fills the bags with the dirt or sand and stacks the bags to form the barrier. With reference to FIG. 1, the bags are often stacked so as to form a barrier with a "pyramid" cross-section 100 that is widest at the base, and narrower at the top.

In some cases, the barrier 100 is constructed on flat ground, and the weight of the sand in the barrier 100 is sufficient to hold the barrier 100 in place during the flood or other threat. With reference to FIG. 2, in other cases a shallow trench 200 is prepared first, the trench having a depth that is approximately equal to the thickness of one sandbag. One or two rows of sandbags 202 are laid in the trench 200, with the remainder of the barrier 100 being constructed on top of the initial one or two rows 202. In this way, friction between the sandbags in the trench and the remainder of the sandbags further helps to hold the barrier in place.

While a sandbag barrier is generally effective and the materials are relatively inexpensive, there can be significant costs and construction time associated with a sandbag dike, due to the requirement to bring the sand or dirt to the construction site, which may weigh many tons, and due to the need to employ significant labor to fill and stack the bags.

In addition, after the flood or other threat has subsided, disposal of the sandbags can be time consuming and costly, especially if the sand and bags have become wet and contaminated by flood water and require special disposal procedures to avoid risks to health and to the environment.

What is needed, therefore, is a portable dike, wall, or other barrier that functions in a manner similar to a sandbag dike or wall, but does not require delivery of large quantities of heavy materials to the construction site, does not require large amounts of labor to assemble, and is simple and inexpensive to remove when it is no longer needed.

SUMMARY OF THE INVENTION

A portable, modular, water-inflatable barrier has an internal structure similar to a sandbag dike or wall, and functions in a similar manner, but does not require delivery of large quantities of heavy materials to the construction site, does not require large amounts of labor to assemble, and is simple and inexpensive to remove when no longer needed. The barrier comprises a plurality of interconnected, water-inflatable modules, each of which is made of a light, flexible material such as a heavy plastic or nanofiber. The modules can be transported to the construction site in a deflated state, after which they can be positioned, interconnected, and filled with locally available water. In embodiments, each module weighs less than 250 pounds, such that they can be lifted and carried without heavy machinery.

Each module of the barrier is a single unit that includes shaping and internal partitions which create an overall structure similar to a pile of sandbags in a sandbag wall. The interiors of the barrier modules are divided into pluralities of approximately rectangular cells. Passages between the tops and bottoms of the cells in each module allow each of the modules to be filled from a single water inlet. Embodiments include a manifold that allows an entire assembly of modules to be simultaneously filled from a single water inlet.

In some embodiments, the cells in each module include passive automatic valves that seal the passages between the cells after the cells are filled with water, so that deflation of one cell in a module due to a puncture or some other cause will not cause the cells beneath it to deflate. In some embodiments, the outer shells of the barrier modules are made of a material that is thicker than the interior dividing walls, such as thick plastic, a synthetic rubber, or a thick layer of nanofiber, so as to better resist puncture by an external threat. In similar embodiments, the outer shells are double-walled, so that puncture of the outer wall does not affect the internal cells, so long as the inner wall remains intact. In certain embodiments the walls are coated with a protective material such as tyvec or liquid rubber that will seal punctures if they occur.

The internal structures of the barrier modules enable them to maintain their shape when the barrier is subjected to externally applied horizontal forces, such as pressure from flood waters. In some embodiments, the shape of the structure is made even more rigid by the inclusion within the cells of stiff, lightweight rods or plates made of plastic, bamboo, or a similar material.

In further embodiments, additional cells extend below the bases of the inflatable barrier modules, so that they can be placed in a trench prepared at the construction site, thereby further resisting dislodgement of the barrier by flood waters or other forces.

In some embodiments, the barrier modules can be initially inflated with air, so that they can be easily positioned and interconnected. The barrier modules can then be filled with water, while the displaced air is released through a pressure valve at the top of the barrier.

In some embodiments, the barrier modules have interlocking ends that provide structural cooperation and a watertight seal between adjacent barrier modules. In some of these embodiments, pre-inflation of the barrier modules with air allows them to be easily placed in their interlocking configuration before the air within the barrier modules is replaced by water.

Embodiments of the present invention include an anchoring sheet that extends flat against the ground in front of the barrier, so that the weight of the water in front of the barrier presses the anchoring sheet against the ground and creates a high frictional resistance to movement, thereby anchoring the barrier in place. In some embodiments, the anchoring sheet can be folded over the water-facing surface of the barrier so as to prevent water from leaking between the modules. In some of these embodiments, the covering sheet is made from a material that naturally clings to the water-facing surface of the barrier due to static electrical attraction.

Other embodiments include a flexible underlying sheet that further resists puncture from beneath, and which seals to the ground so as to resist penetration of water beneath the barrier. In some of these embodiments, the underlying sheet includes a cushioning layer. In still other of these embodiments, the underlying sheet is filled with dry sand, foam or some other compliant material that will not get wet from the flood water.

A first general aspect of the present invention is a water-inflatable barrier system that includes a plurality of substantially identical barrier modules. Each of the barrier modules includes flexible walls forming a module shell configured to contain water within an interior of the module, said module shell having a front, a rear, a length parallel to the front, a width perpendicular to the front, and a substantially uniform cross-section along its length, the cross section being wider at a bottom of the module than at a top of the module, a plurality of substantially horizontal and substantially vertical partition walls dividing said interior of said module into a plurality of adjacent, water-tight cells shaped as rectangular parallelepipeds, front and rear partition walls of each cell being substantially parallel to the front of the module shell, said cells being arranged in a plurality of vertically stacked layers that are offset from each other such that none of the front and rear partition walls aligns with a front or rear partition wall in a vertically adjacent layer, a water inlet in liquid communication with the interior of the module, and a plurality of passages between the cells of the module that are configured to allow filling of all of the cells of the module with water from the water inlet. The barrier system further includes a fastening mechanism configured for interconnection of the plurality of modules in a fixed, adjoining, aligned relationship so as to form a barrier having a width that is substantially equal to the widths of the individual barrier modules, and a length that is substantially equal to a sum of the plurality of module lengths.

In embodiments, the fastening mechanism includes attachment features fixed to each of the modules. In some of these embodiments, at least one of the attachment features is a loop or ring. In any of these embodiments, at least one the attachment features can be fixed to a top surface of one of the modules. In any of these embodiments, at least one of the attachment features can be fixed to a front surface of one of the modules.

In any of the above embodiments, the fastening mechanism can further include at least one strap configured for joining at least two of the attachment features to each other. In some of these embodiments, the strap is made of leather, plastic, or canvas webbing. In any of these embodiments, the fastening mechanism can include a plurality of straps configured for attaching adjacent attachment features to each other. And in any of these embodiments, the attachment features can include rings or loops, and the strap can be configured to extend through at least three of the rings or loops, and to extend around at least two of the modules.

Any of the above embodiments can further include an automatic valve cooperative with a vertical passage between adjacent cells and configured to automatically seal the vertical passage when the cell below the vertical passage is filled with water.

Any of the above embodiments can further include an automatic valve cooperative with a horizontal passage between adjacent cells and configured to automatically seal the horizontal passage when the cell located to the rear of the horizontal opening is filled with water.

In any of the above embodiments, each of the barrier modules can include a side structure having a staggered arrangement of cells configured to be interleaved with cells of an adjacent module.

In any of the above embodiments, the flexible walls can include a coating of a protective material that tends to seal punctures. In some of these embodiments, the protective material is tyvec or liquid rubber.

Any of the above embodiments can further include a manifold that is connectable to the aligned, interconnected modules so as to enable the modules to be simultaneously filled with water.

In any of the above embodiments, each module can weigh less than 250 pounds.

A second general aspect of the present invention is a method of constructing a barrier assembly. The method includes providing a plurality of substantially identical barrier modules. Each of the modules includes flexible walls forming a module shell configured to contain water within an interior of the module, said module shell having a front, a rear, a length parallel to the front, a width perpendicular to the front, and a substantially uniform cross-section along its length, the cross section being wider at a bottom of the module than at a top of the module, a plurality of substantially horizontal and substantially vertical partition walls dividing said interior of said module into a plurality of adjacent, water-tight cells shaped as rectangular parallelepipeds, front and rear partition walls of each cell being substantially parallel to the front of the module shell, said cells being arranged in a plurality of vertically stacked layers that are offset from each other such that none of the front and rear partition walls aligns with a front or rear partition wall in a vertically adjacent layer, a water inlet in liquid communication with the interior of the module, a plurality of passages between the cells of the module that are configured to allow filling of all of the cells of the module with water from the water inlet, and a fastening mechanism configured for interconnection of the plurality of modules in a fixed, adjoining, aligned relationship so as to form a barrier having a width that is substantially equal to the widths of the individual barrier modules, and a length that is substantially equal to a sum of the plurality of module lengths.

The method further includes placing the modules at a desired location, aligning the modules in an adjoining, substantially aligned relationship whereby the fronts and rears of the module shells are substantially parallel and aligned, using the fastening mechanism to interconnect the modules with each other, and inflating the modules with water.

In embodiments, the method further includes connecting a manifold to a plurality of the aligned, interconnected modules, and connecting the manifold to a source of water, so as to simultaneously fill with water the plurality of modules that are connected to the manifold.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a portable, modular, water-inflatable barrier that has a structure similar to a sandbag dike or wall 100 and functions in a similar manner, but does not require delivery of large quantities of heavy materials to the construction site, does not require large amounts of labor to assemble, and is simple and inexpensive to remove when no longer needed. The barrier comprises an assembly of modules 300, each of which is made of a light, flexible material, such as a heavy plastic for nanofiber, and can be transported to the construction site in a deflated state, after which it is positioned and filled with locally available water. In embodiments, the modules 300 are coated with a material such as tyvec or liquid rubber that will tend to seal any puncture of the material that may occur. In some embodiments, each module 300 weights less than 250 pounds, so that it can be lifted and carried without using heavy machinery.

Figure 1:
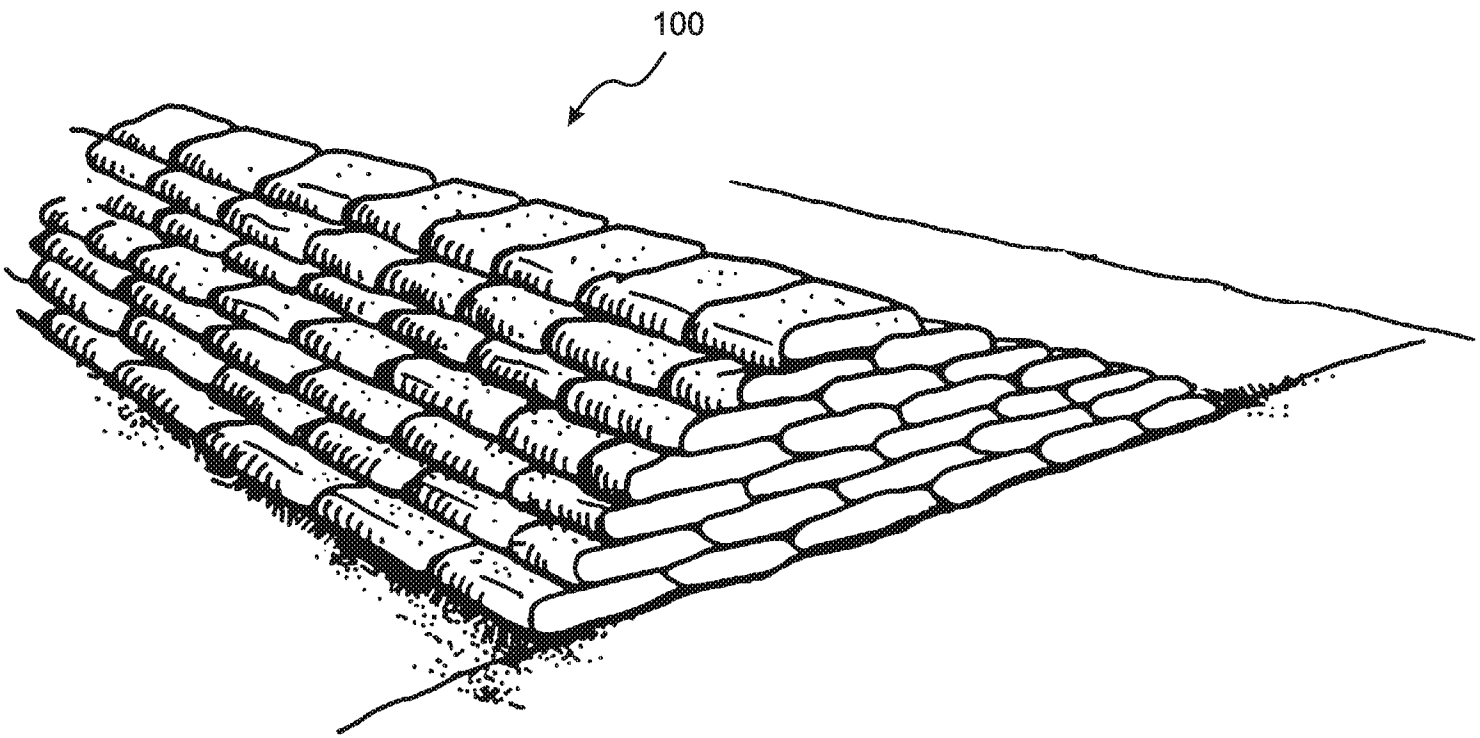
Figure 1 Prior Art
FIG. 1 is perspective view of a sandbag barrier of the prior art having a flat base.
Figure 2:
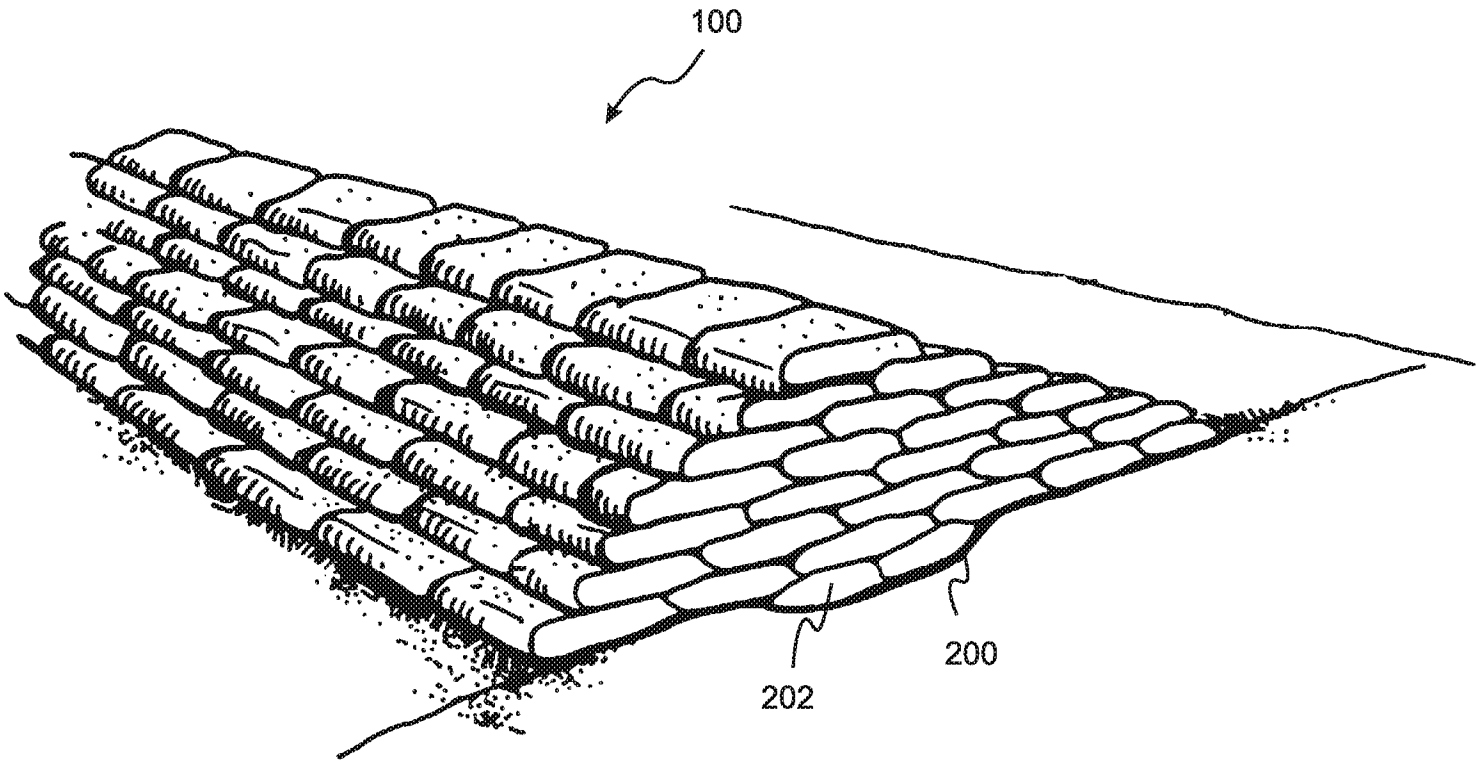
Figure 2 Prior Art
FIG. 2 is perspective view of a sandbag barrier of the prior art having two rows of sandbags at its base that are placed in a trench prepared at the construction site.
Figure 3:
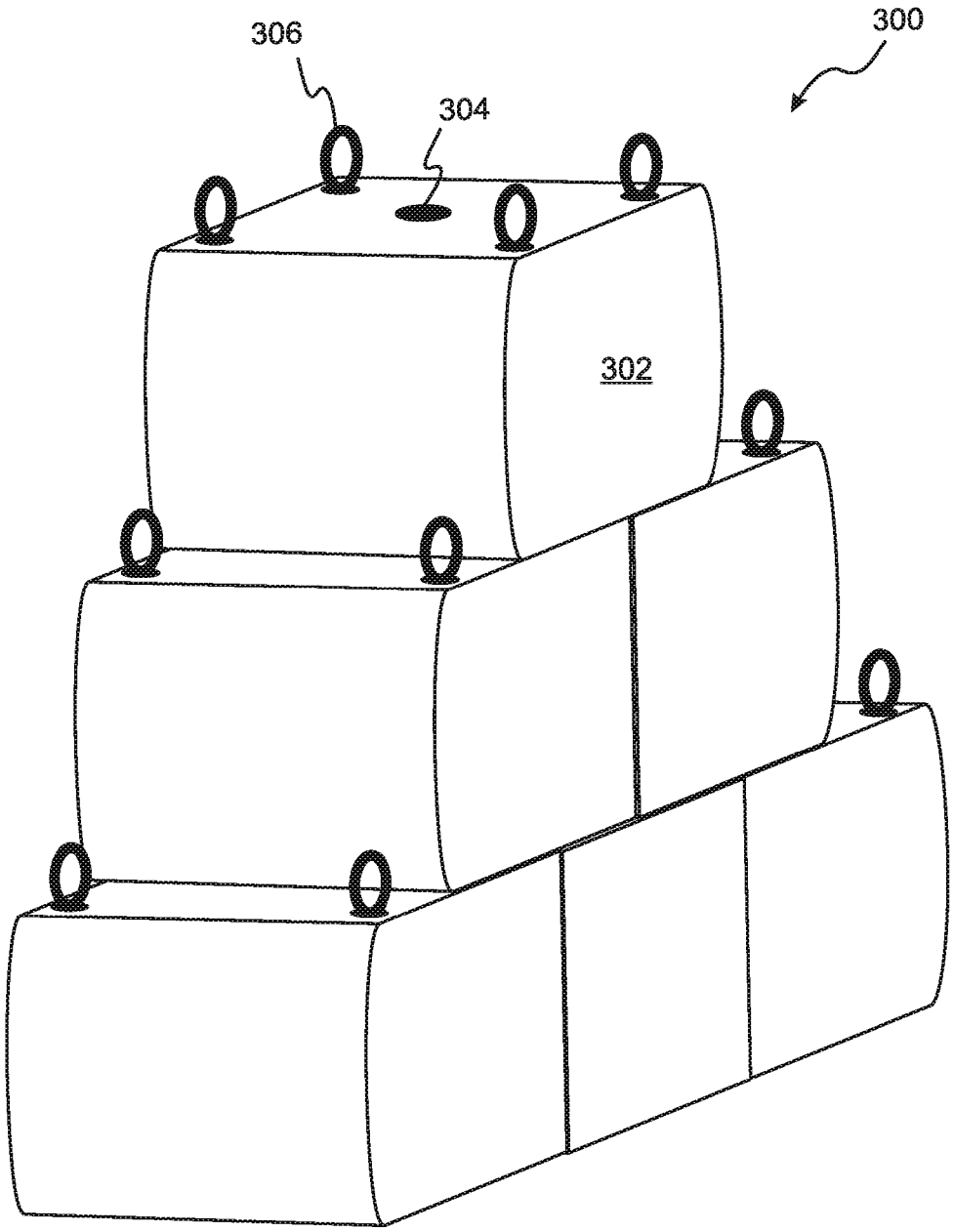
FIG. 3 is a perspective view of a single module that is one cell in length in an embodiment of the present invention.
Figure 4A:
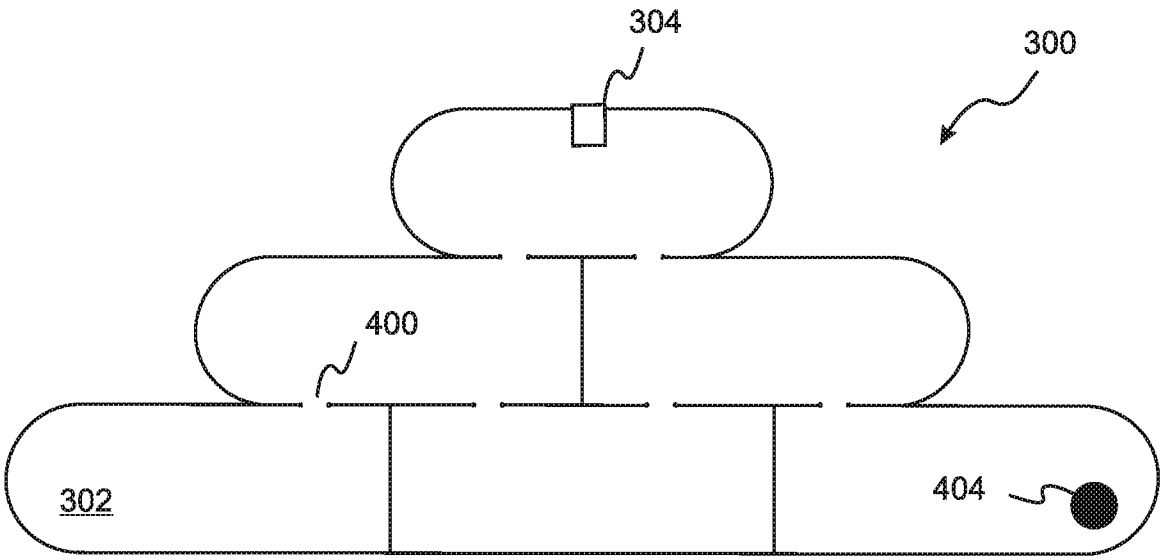
FIG. 4A is a cross sectional view of a module in an embodiment having a water inlet on top, a water outlet near the bottom, and simple passages between tops and bottoms of cells.

In the embodiment of FIG. 3, the interior of the module is divided into a plurality of approximately rectangular cells 302. A port 304 for filing and/or emptying the module 300 is provided in the top surface, and interconnection loops 306 are provided so as to facilitate interconnection of the modules 300 into a complete barrier. With reference to FIG. 4A, passages 400 between the tops and bottoms of the cells 302 allow the entire module 300 to be filled from a single water inlet 304. In the illustrated embodiment, a separate water outlet 404 is provided at the base of the structure 300.

Figure 4B:
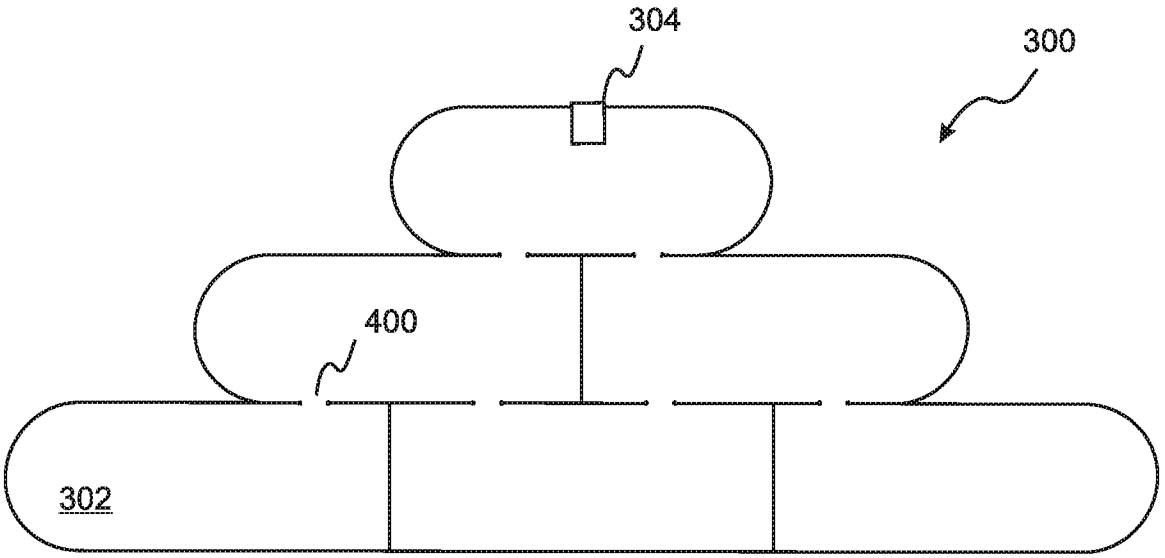
FIG. 4B is a cross sectional view of a module in an embodiment similar to FIG. 4A, but including only a water port at the top through which the barrier is both filled and emptied with water.

With reference to FIG. 4B, in some embodiments a separate water outlet 404 is not included, and instead water is both added and removed through a common port 304 at or near the top or bottom of the barrier module 300. This allows water to be removed from the barrier module 300 without introducing air, so that removing the water causes the barrier module to be collapsed in preparation for packing and transport.

In some embodiments, lateral passages (not shown) are provided at least between adjoining cells in the bottom rear row, so that a single outlet can drain all of the cells 302 in the barrier module 300.

Figure 5:
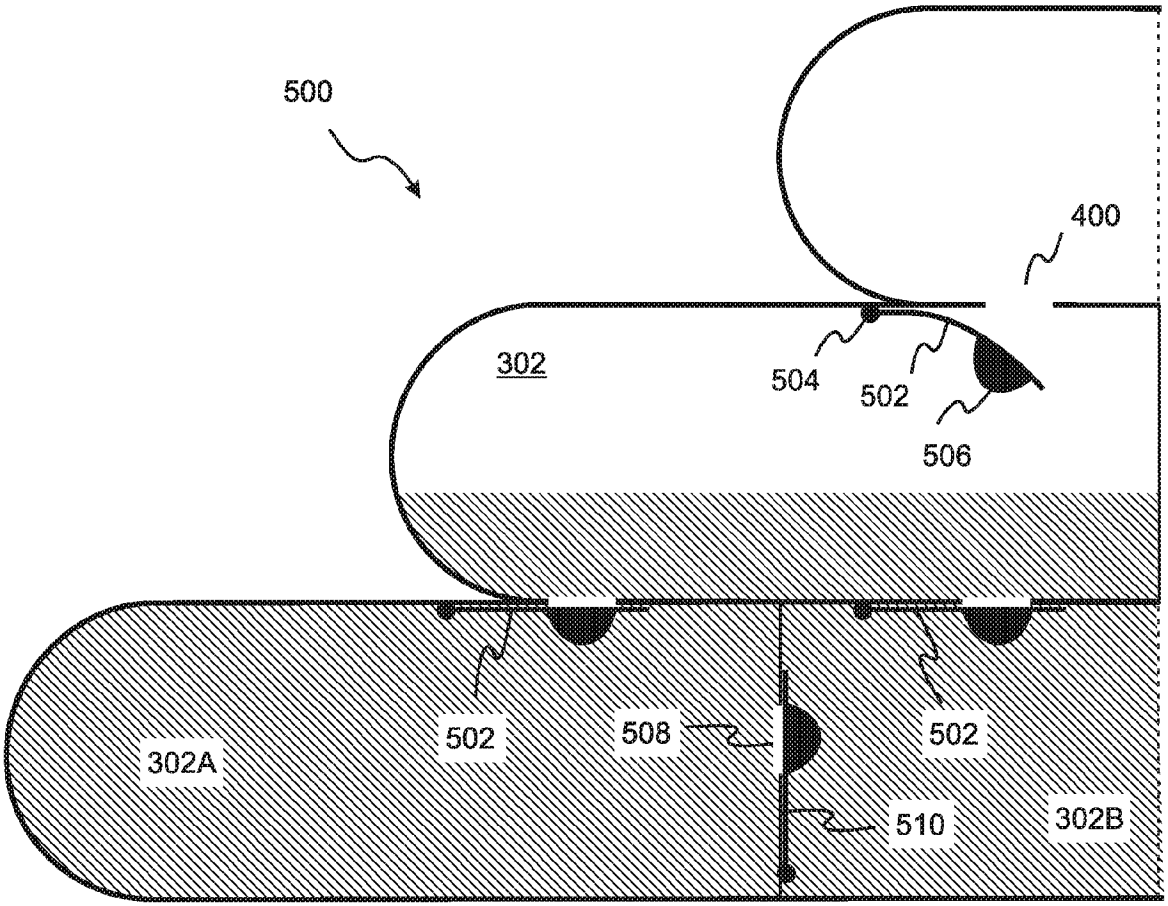
FIG. 5 is a partial cross sectional view of a module in an embodiment having passages between tops and bottoms of cells that are closable by passive valves.

With reference to FIG. 5, in some embodiments 500 the cells 302 include passive automatic valves 500 that seal the passages 400 after the cells 302 are filled with water, so that deflation of one cell due to a puncture or some other cause will not cause the cells beneath it to deflate. In the embodiment 500 of FIG. 5, the valves 502 are flaps of elastic material joined to the upper surfaces of the cells 302 by living hinges 504. A small air bladder 506 is included in the region of the valve 502 that is positioned to cover the passage 400. When the cell 302 is empty, gravity causes the valve 502 to fall away from the passage 400, so that the cell 302 can fill with water. However, once the cell 302 is full of water, the air bladder 506 lifts the valve 502 into place and closes the passage 400. Once the valves 502 are closed, if a cell should develop a leak and deflate, only the cells directly above it will be affected.

In addition, the embodiment 500 of FIG. 5 includes lateral passages 508 between neighboring cells at the lowest level of the barrier, so that the entire barrier can be emptied through a single water outlet 404 located at the lower rear of the structure 500. These lateral passages 508 include automatic valves 510 that will allow water to flow toward the rear as the cells empty from back to front, but will prevent water flowing from rear to front if one of the front cells is damaged.

Typically, the cells in the front row 302, 302A will be the cells that are directly exposed to threats such as debris carried by flood waters. The front cells 302, 302A are therefore the ones most likely to be damaged or punctured. In the embodiment of FIG. 5, if a cell 302A in the bottom front row is punctured, the lateral valve 510 will prevent water from flowing out of the cell next to it 302B and into the damaged cell 302A. However, if the rear cells 302B are drained first during the normal drainage process, then the lateral valves 510 will open and water from the front cells 302A will flow out.

Figure 6A:
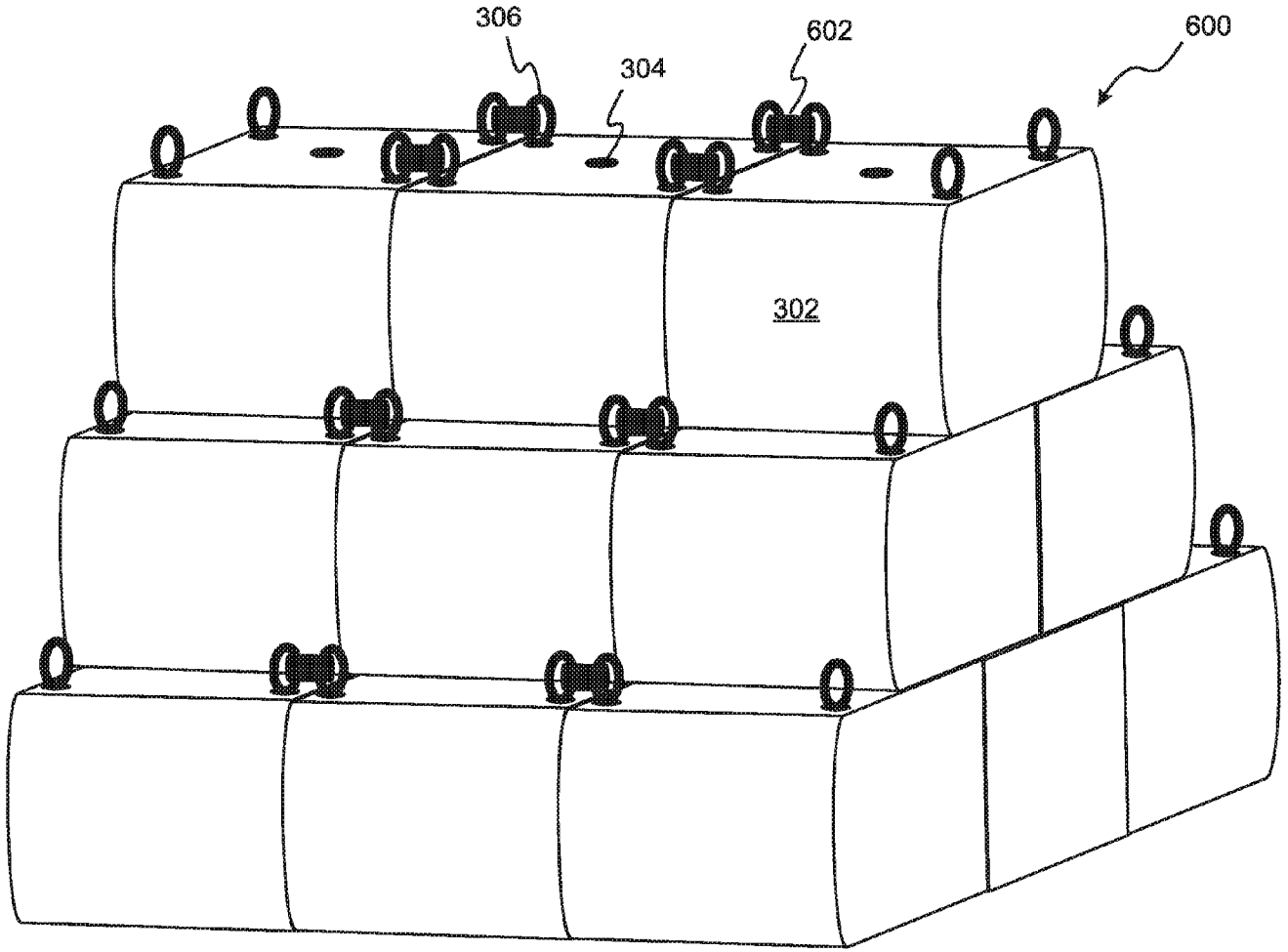
FIG. 6A is a perspective view showing three of the modules of FIG. 3 interconnected using loops and straps to form a partial barrier.
Figure 6B:
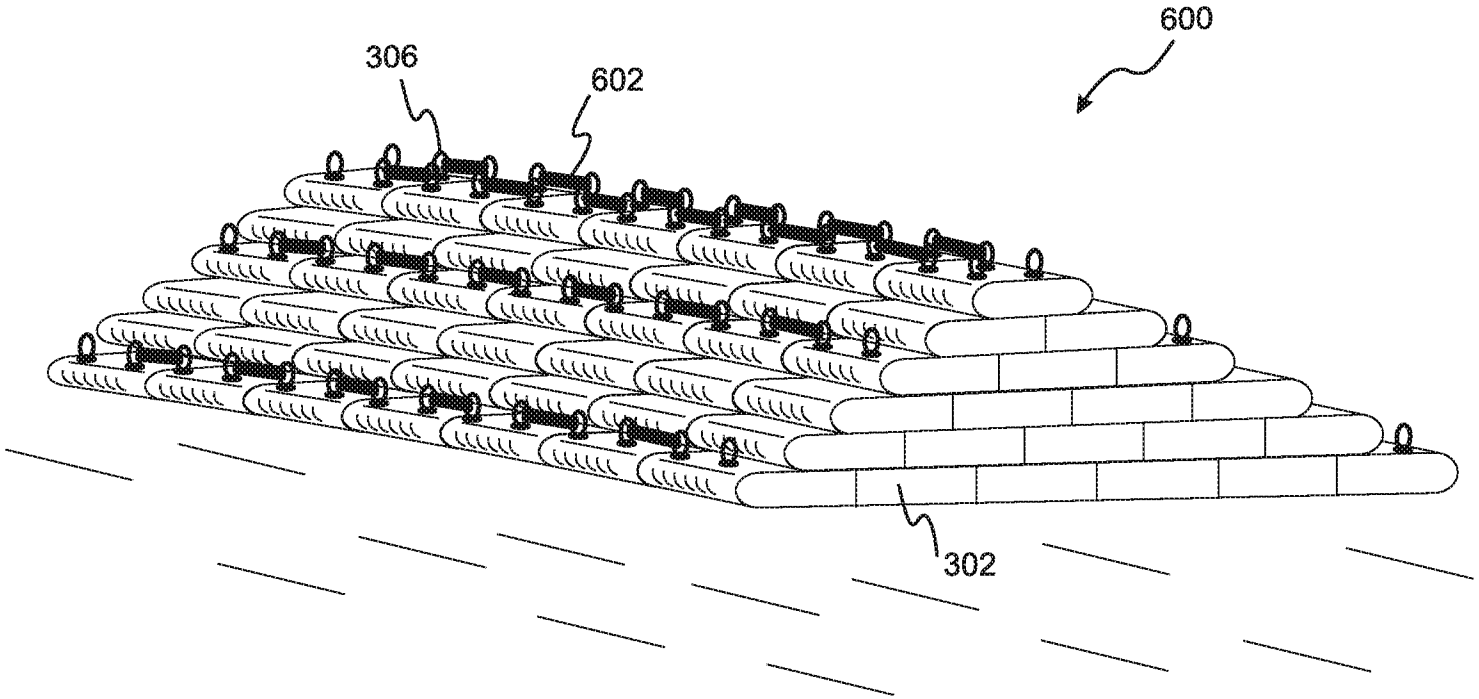
FIG. 6B is a perspective view of an entire barrier according to the embodiment of FIG. 6A.

The barrier of the present invention comprises a plurality of modules 300 that are arranged side-by-side and coupled to each other. FIG. 6A illustrates the interconnection of three of the modules 300 illustrated in FIG. 3 so as to form at least part of a barrier 600. In this embodiment, the coupling mechanism that interconnects the modules 300 comprises loops 306 that are attached to the upper surfaces of the cells, whereby adjacent loops of adjoining modules are attached by straps 602. In similar embodiments, the loops 306 are interconnected by clamps or other fastening means known in the art. FIG. 6B is a perspective view of an entire barrier 600 of coupled modules 300 according to the embodiment of FIG. 6A.

Figure 7:
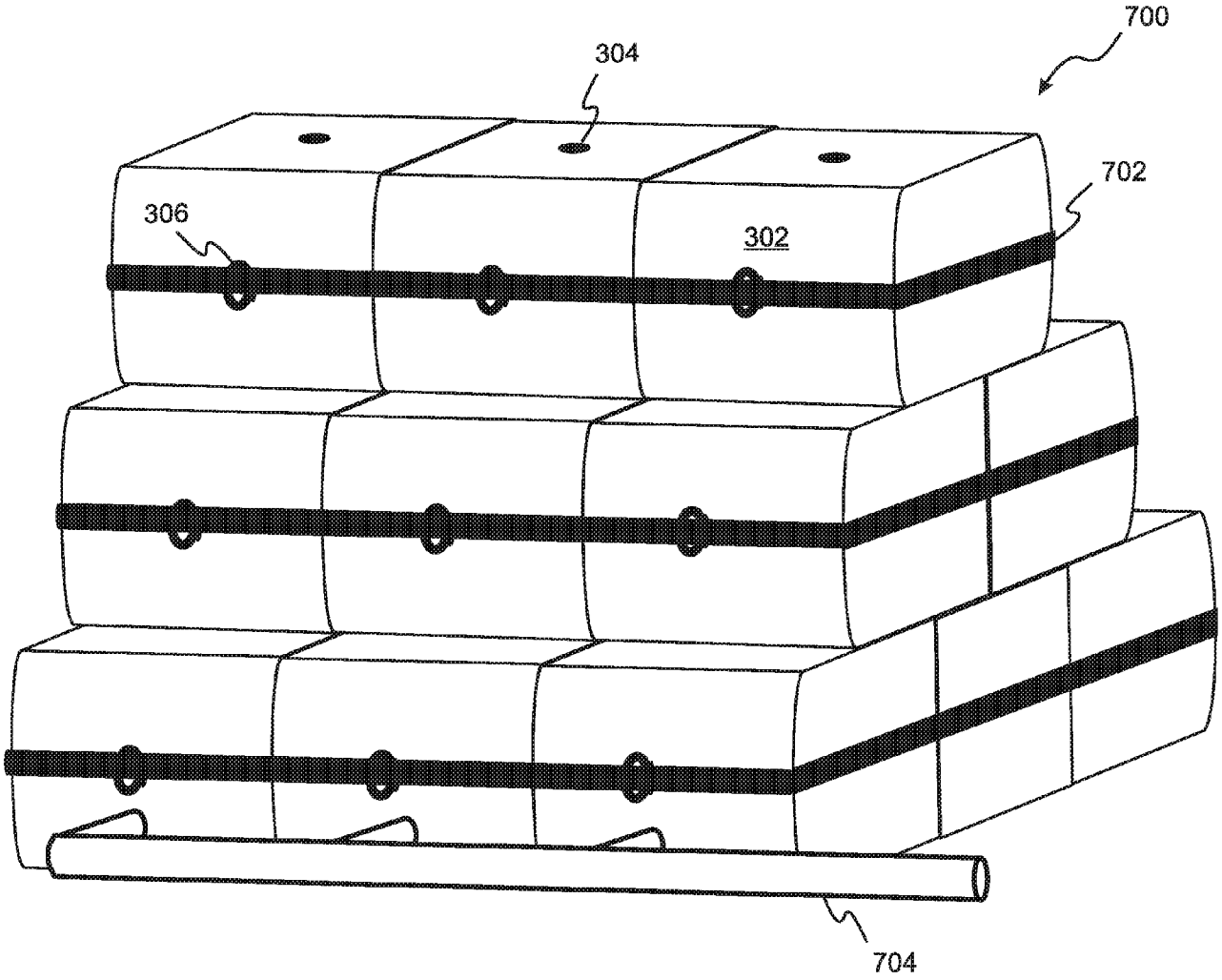
FIG. 7 is a perspective view of an embodiment similar to FIG. 6A, but wherein a single strap extends through loops positioned on front faces of more than two of the modules.

FIG. 7 is a perspective rear view of an embodiment 700 similar to FIG. 6A, except that the loops 306 are located on both the front-facing and rear-facing surfaces of the modules 300, and a single, continuous strap 702 is passed through the loops 306 and around the modules 300 so as to attach the modules 300 and form the barrier 700. The embodiment of FIG. 7 also includes a manifold 704 that can be used to fill all of the modules 300 simultaneously through fill-ports provided in the bases of the modules 300.

Figure 8:
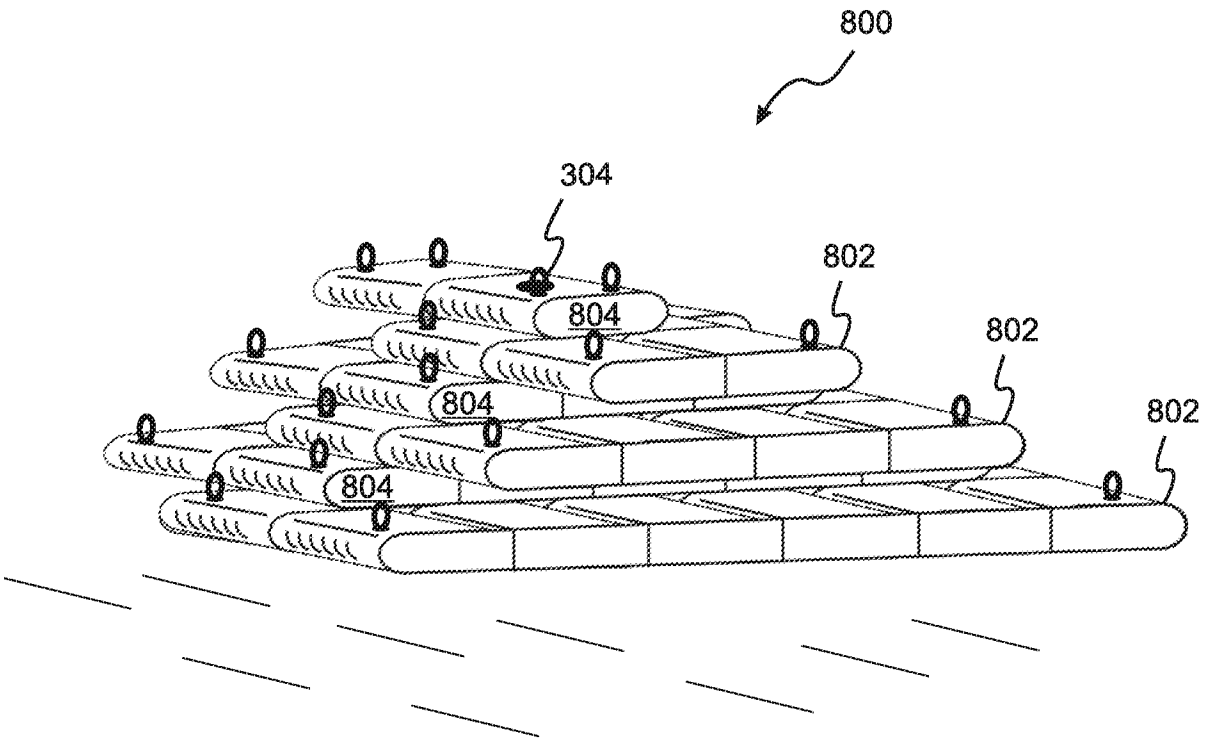
FIG. 8 is a perspective view of a module in an embodiment where the module that has interlocking ends.

With reference to FIG. 8, in some embodiments the barrier modules 800 have interlocking ends that provide structural cooperation and a water-tight seal between adjacent modules. FIG. 8 is a perspective view of a single module 800 that is three cells wide. The module includes alternate rows of cells 802 that extend from the ends by a length of one cell, while the interleaved rows 804 do not. The opposite pattern is provided on the other end of the module 800. It can be seen that a second module of the same configuration can be positioned so that its extended cells fit between the extended cells 802 of the adjacent module 800. In some of these embodiments, as mentioned above, the modules 800 can be initially filled with air and positioned with the ends interlocking, after which the modules 800 are filled with water while the displaced air is allowed to escape through pressure valves 304 provided at the tops of the modules 800.

Figure 9:
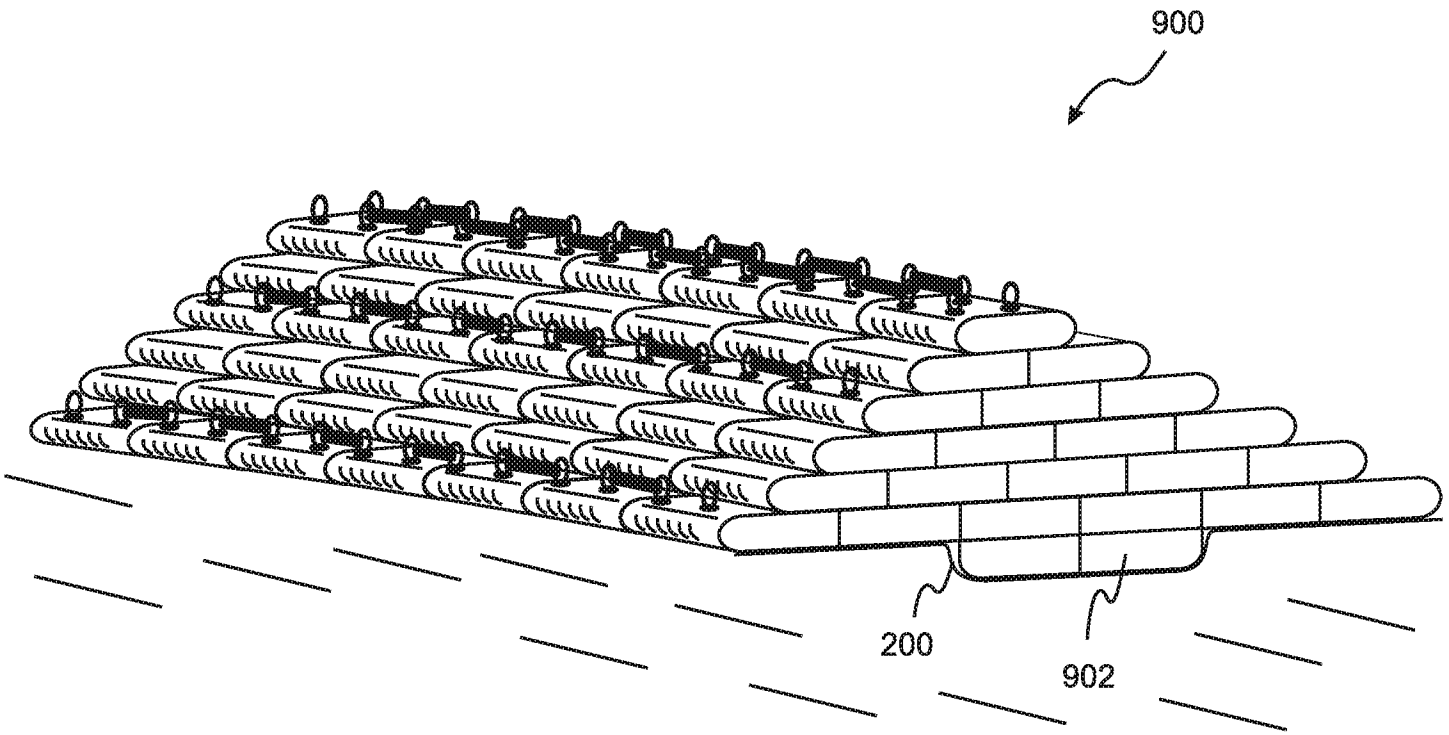
FIG. 9 is a perspective view of an embodiment wherein the barrier has two additional rows of cells at its base that are placed in a trench prepared at the construction site.

With reference to FIG. 9, in further embodiments, additional rows 902 of cells extend below the base of the inflatable barrier 900 so that they can be placed in a trench 200 prepared at the construction site, thereby further resisting dislodgement of the barrier 900 by flood waters or other forces.

Figure 10:
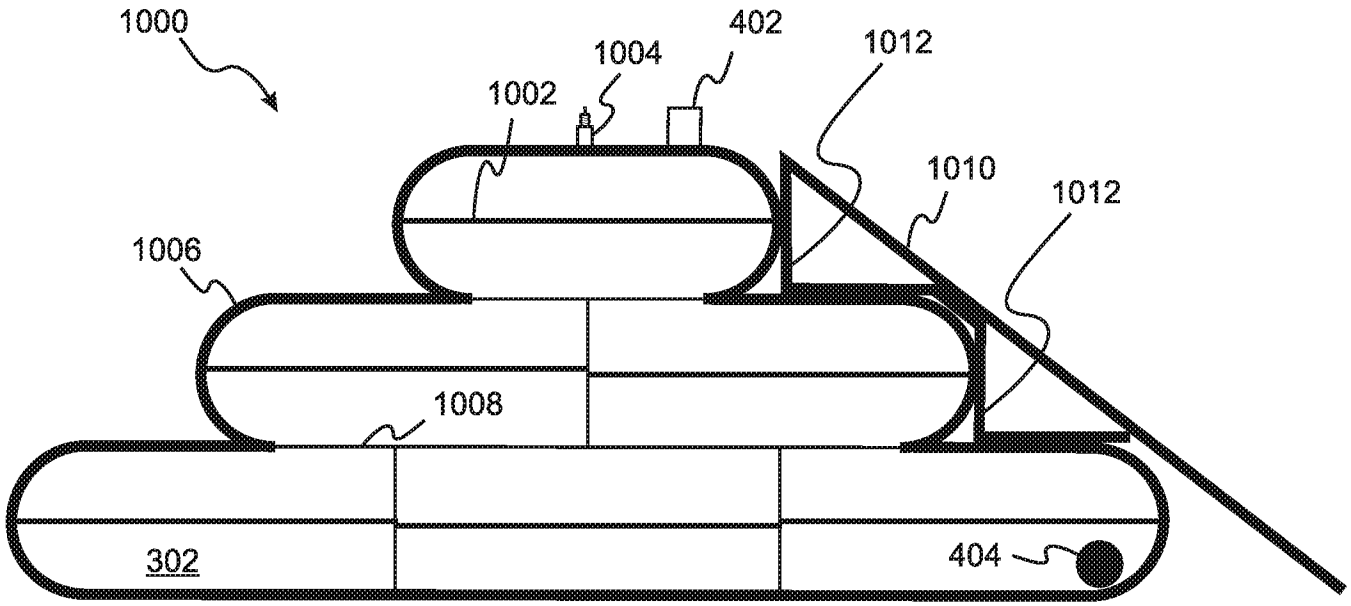
FIG. 10 is a cross sectional view of an embodiment that includes stiffening rods within the cells and a series of bent metal rods located at intervals along the rear side of the barrier 1000.

With reference to FIG. 10, in some embodiments the outer shell is made of a much thicker material than the internal cell walls 1008, so as to better resist puncture by exterior threats. In similar embodiments, the outer shell 1006 is a double layer of material, so that penetration of the outer layer does not affect the adjacent cell, so long as the inner layer remains intact. In some embodiments, only the portion of the outer shell 1006 that will face the flood or other threat is thicker, double-walled, or otherwise reinforced.

In embodiments, the internal cell walls enable the barrier 300 to maintain its shape when it is subjected to externally applied, lateral forces, such as pressure from flood waters. As illustrated in FIG. 10, in some embodiments, the shape of the barrier 1000 is made even more rigid by including within the cells 302 stiff, lightweight rods 1002 or panels made of plastic, bamboo, or a similar material.

In certain embodiments, the shape of the barrier is supported by external reinforcing structures. The embodiment of FIG. 10 includes a plurality of bent metal rods 1010 that can be located at intervals along the rear side of the barrier 1000. The rods 1010 include vertical sections 1012 that can be placed against the back sides of cells at the rear of the barrier 1000 so as to provide further resistance to horizontal forces applied to the front of the barrier.

Figure 11:
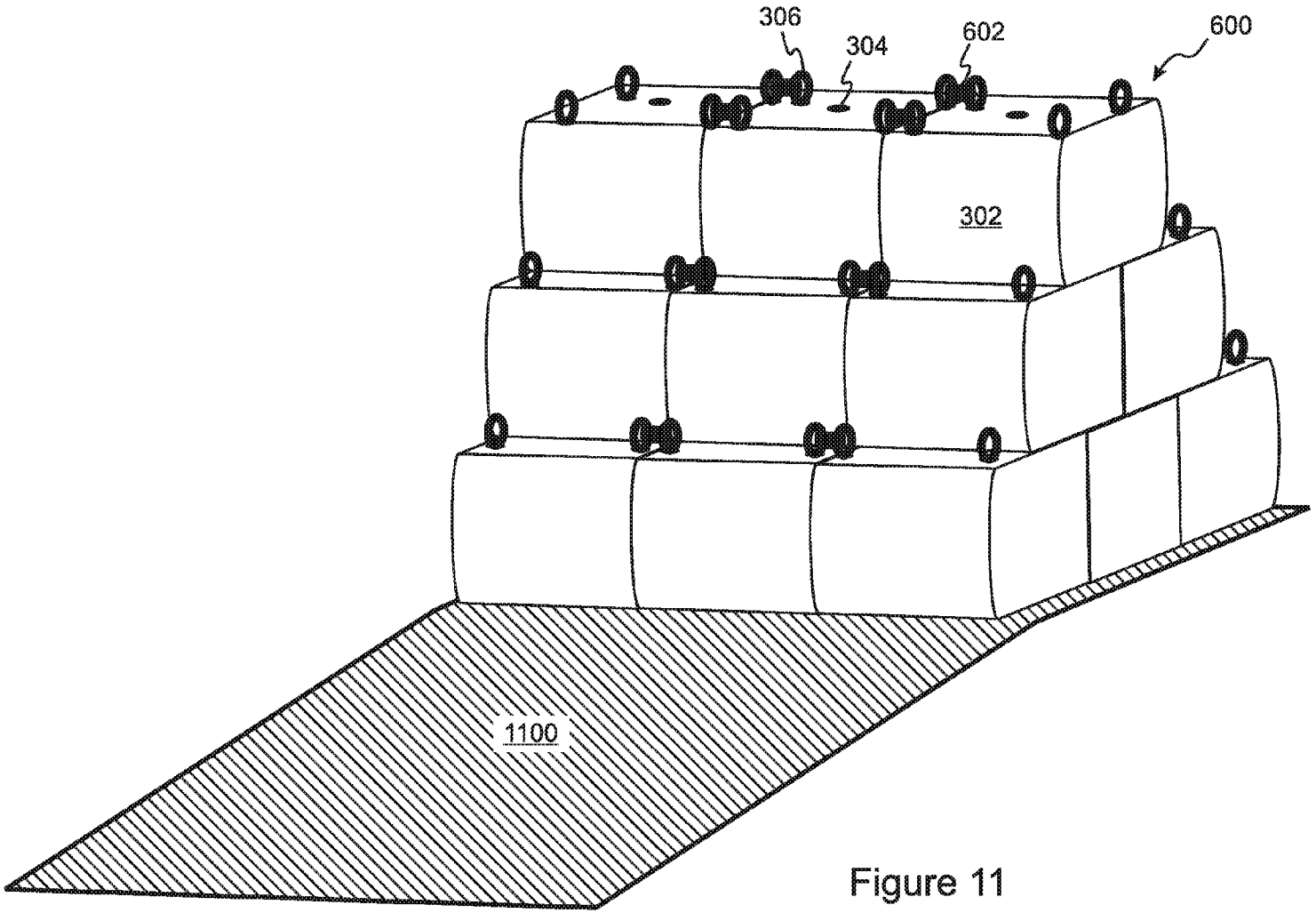
FIG. 11 is a perspective view of an embodiment that includes an anchoring sheet underlying the barrier and extending under the water to as to further resist lateral displacement of the barrier by the water.

The embodiment of FIG. 11 is similar to FIG. 6A, except that it further includes an anchoring sheet 1100 that is attached to the barrier 600 and extends in front of the barrier 600, where it is pressed against the ground by the water in front of the barrier, so that there is a high friction between the anchoring sheet 1100 and the ground that further inhibits lateral movement of the barrier 600 by the water.

In embodiments, the flexible material of the barrier 600 allows the base of the barrier 600 to form a seal with ground even if the ground is rough. In the embodiment of FIG. 11, the underlying sheet 1100 also increases resistance to puncture of the barrier 600 from beneath, and also forms a seal with the ground so as to further resist penetration of water beneath the barrier 600. In some of these embodiments, the underlying sheet 1100 includes a cushioning layer such as foam or a puncture-proof air bag that enables the underlying sheet to form a seal with very rough ground, and also further helps to avoid puncture of the barrier from beneath. In certain of these embodiments, the underlying sheet 1100 is filled with dry sand, foam or some other compliant material that will not get wet from the flood water.

Figure 12:
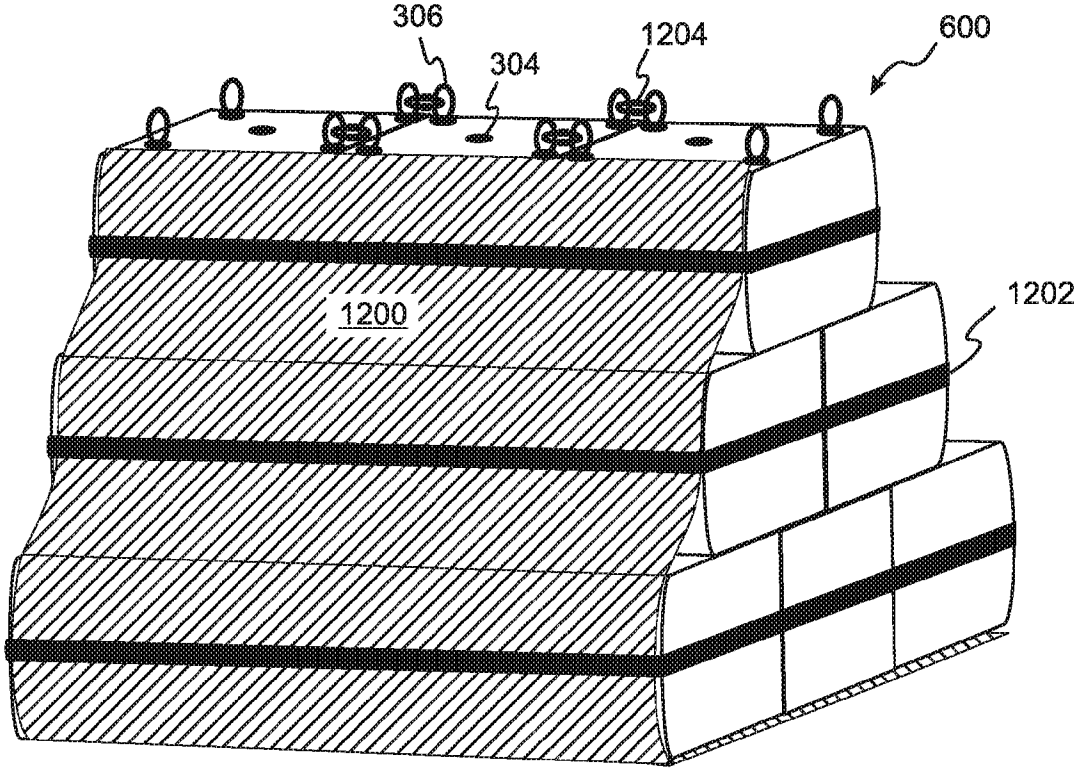
FIG. 12 is a perspective view of an embodiment that includes a covering sheet that extends under the barrier and over the front face of the barrier, so as to inhibit leakage of water under and between the cells.

As illustrated in FIG. 12, similar embodiments include a cover sheet 1200 that is placed beneath the barrier 600, and extends in front of the barrier 600, so that it can be folded over the front of the barrier 600 to prevent water from leaking between the modules 300. In the embodiment of FIG. 11B, the sheet 1200 is attached to the front surface of the barrier 600 by surrounding straps 1202. Note also that in the embodiment of FIG. 12, the rings (or loops) 306 are joined by separable attachment loops 1204 rather than by straps 602. In similar embodiments, clamps or other attachment means known in the art are used to attach together the rings 306, flaps, or other attachment features included in the modules.

In embodiments, the cover sheet 1200 is sufficiently flexible to allow it to conform closely to the underlying shape of the water-facing surface of the barrier 600. And in some of these embodiments, the cover sheet 1200 is made from a material that naturally clings to the water-facing surface of the barrier 600 due to static electrical attraction.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A water-inflatable barrier system comprising:

a plurality of substantially identical barrier modules, each of the modules including:

flexible walls forming a module shell configured to contain water within an interior of the module, said module shell having a front, a rear, a length parallel to the front, a width perpendicular to the front, and a substantially uniform cross-section along its length, the cross section being wider at a bottom of the module than at a top of the module;

a plurality of substantially horizontal and substantially vertical partition walls dividing said interior of said module into a plurality of adjacent, water-tight cells shaped as rectangular parallelepipeds, front and rear partition walls of each cell being substantially parallel to the front of the module shell, said cells being arranged in a plurality of vertically stacked layers that are offset from each other such that none of the front and rear partition walls aligns with a front or rear partition wall in a vertically adjacent layer;

a water inlet in liquid communication with the interior of the module;

a plurality of passages between the cells of the module that are configured to allow filling of all of the cells of the module with water from the water inlet; and a fastening mechanism configured for interconnection of the plurality of modules in a fixed, adjoining, aligned relationship so as to form a barrier having a width that is substantially equal to the widths of the individual barrier modules, and a length that is substantially equal to a sum of the plurality of module lengths.

2. The system of claim 1, wherein the fastening mechanism includes attachment features fixed to each of the modules.

3. The system of claim 2, wherein at least one of the attachment features is a loop or ring.

4. The system of claim 2, wherein at least one of the attachment features is fixed to a top surface of one of the modules.

5. The system of claim 2, wherein at least one of the attachment features is fixed to a front surface of one of the modules.

6. The system of claim 1, wherein the fastening mechanism further comprises at least one strap configured for joining at least two of the attachment features to each other.

7. The system of claim 6, wherein the strap is made of leather, plastic, or canvas webbing.

8. The system of claim 6, wherein the fastening mechanism comprises a plurality of straps configured for attaching adjacent attachment features to each other.

9. The system of claim 6, wherein the attachment features include rings or loops, and the strap is configured to extend through at least three of the rings or loops, and to extend around at least two of the modules.

10. The system of claim 1, further comprising an automatic valve cooperative with a vertical passage between adjacent cells and configured to automatically seal the vertical passage when the cell below the vertical passage is filled with water.

11. The system of claim 1, further comprising an automatic valve cooperative with a horizontal passage between adjacent cells and configured to automatically seal the horizontal passage when the cell located to the rear of the horizontal opening is filled with water.

12. The system of claim 1, wherein each of the barrier modules includes a side structure having a staggered arrangement of cells configured to be interleaved with cells of an adjacent module.

13. The system of claim 1, wherein the flexible walls include a coating of a protective material that tends to seal punctures.

14. The system of claim 13, wherein the protective material is tyvec or liquid rubber.

15. The system of claim 1, further comprising a manifold that is connectable to the aligned, interconnected modules so as to enable the modules to be simultaneously filled with water.

16. The system of claim 1, wherein each module weighs less than 250 pounds.

17. A method of constructing a barrier assembly, the method comprising:

providing a plurality of substantially identical barrier modules, each of the modules including:

flexible walls forming a module shell configured to contain water within an interior of the module, said module shell having a front, a rear, a length parallel to the front, a width perpendicular to the front, and a substantially uniform cross-section along its length, the cross section being wider at a bottom of the module than at a top of the module;

a plurality of substantially horizontal and substantially vertical partition walls dividing said interior of said module into a plurality of adjacent, water-tight cells shaped as rectangular parallelepipeds, front and rear partition walls of each cell being substantially parallel to the front of the module shell, said cells being arranged in a plurality of vertically stacked layers that are offset from each other such that none of the front and rear partition walls aligns with a front or rear partition wall in a vertically adjacent layer;

a water inlet in liquid communication with the interior of the module;

a plurality of passages between the cells of the module that are configured to allow filling of all of the cells of the module with water from the water inlet; and a fastening mechanism configured for interconnection of the plurality of modules in a fixed, adjoining, aligned relationship so as to form a barrier having a width that is substantially equal to the widths of the individual barrier modules, and a length that is substantially equal to a sum of the plurality of module lengths;

placing the modules at a desired location;

aligning the modules in an adjoining, substantially aligned relationship whereby the fronts and rears of the module shells are substantially parallel and aligned;

using the fastening mechanism to interconnect the modules with each other; and inflating the modules with water.

18. The method of claim 17, further comprising:

connecting a manifold to a plurality of the aligned, interconnected modules; and connecting the manifold to a source of water, so as to simultaneously fill with water the plurality of modules that are connected to the manifold.

* * * * *